United States Patent [19]

Laskey

[11] 4,156,469

[45] May 29, 1979

[54] METHOD OF AND APPARATUS FOR RECOVERY OF CORES FROM SOFT AND UNCONSOLIDATED EARTH MATERIALS

[76] Inventor: John G. Laskey, 5611 W. Bates Ave., Denver, Colo. 80227

[21] Appl. No.: 835,994

[22] Filed: Sep. 23, 1977

[51] Int. Cl.[2] ..... E21B 9/20

[52] U.S. Cl. ..... 175/58; 175/226; 175/245

[58] Field of Search ..... 175/58, 59, 226, 244, 175/245

[56] References Cited

U.S. PATENT DOCUMENTS

| | | | |
|---|---|---|---|
| 997,358 | 7/1911 | Ameling | 175/244 |
| 3,298,450 | 1/1967 | Sato | 175/226 |
| 3,363,705 | 1/1968 | Jensen | 175/226 |
| 3,511,324 | 5/1970 | Pieters et al. | 175/245 X |
| 3,888,320 | 6/1975 | Maxwell | 175/323 X |

FOREIGN PATENT DOCUMENTS

| | | | |
|---|---|---|---|
| 1313818 | 4/1973 | United Kingdom | 175/226 |

*Primary Examiner*—Ernest R. Purser

*Attorney, Agent, or Firm*—Horace B. Van Valkenburgh; Frank C. Lowe

[57] ABSTRACT

A core barrel having a hollow cutting ring is placed within a hollow drill and connected to a coupling which permits the core barrel to remain stationary while the bit rotates and also produces pressure to force the sharp edge of the cutting ring into the earth formation, the diameter of the cutting edge and inside of the cutting ring being slightly less than the internal diameter of the core barrel. A holder for a resilient sleeve, such as woven of nylon and is bunched onto the holder with the closed end of the sleeve across the open top of the holder, moves upwardly around the core as the core barrel moves downwardly and retains the core, particularly when from a soft formation or loose unconsolidated material, in the same relative position and shape as when cut. The inside diameter of the holder is intermediate that of the cutting ring and the core barrel. An adjustment means determines the axial spacing between the cutting edge of the core barrel cutting ring and the lower edge of the drill bit or teeth.

18 Claims, 10 Drawing Figures

METHOD OF AND APPARATUS FOR RECOVERY OF CORES FROM SOFT AND UNCONSOLIDATED EARTH MATERIALS

The present invention relates to a method of and apparatus for the recovery of core samples, and more particularly for the recovery of core samples of soft formations or loosely consolidated and unconsolidated materials.

BACKGROUND OF THE INVENTION

The art of obtaining cores of soft formations or loosely consolidated and unconsolidated earth materials, hereinafter collectively referred to as "unconsolidated material," requires apparatus and techniques different from the obtaining of cores in hard rock. Many features of core sampling apparatus for unconsolidated materials and for hard rock formations are similar. However, the drilling techniques cannot be the same. In obtaining a core from a hard rock formation, the drill bit must be lubricated and cooled and the cuttings scavenged by fluid flow as the bit cuts the earth about a core. The bit will lead and undercut the core barrel to permit the core to move upwardly and into the barrel for subsequent recovery. In obtaining a core of unconsolidated material, a fluid cannot ordinarily be used since it can easily alter or break apart the core structure. Moreover, the core barrel must lead the cutting bit which circumscribes the core barrel and push its way into the formation ahead of the bit, to maintain the integrity of the core.

It is often necessary to core drill and obtain cores of unconsolidated materials at construction projects and the like, as where the nature of the overburden above bedrock is to be ascertained. Ordinarily, the core drilling of unconsolidated materials will not exceed a depth of more than several hundred feet. Accordingly, a specialized drilling apparatus has been developed for this purpose, which uses a hollow auger with a hollow bit for drilling and removing material from the hole as it is being drilled. A big advantage is that a drilling fluid is not necessary. A hollow auger may have an outside diameter of 8 inches, more or less, with the auger flights mounted upon a hollow axial tube having an inside diameter of 4 inches, more or less.

In drilling operations, sections of the auger, as of five, ten or twenty foot lengths, are connected together to extend the drill string as the depth of the hole increases. In one system of operation, sectional stems having lengths corresponding with the sections of the drill string are extended into the sleeve to carry a drill bit to cut away the central portion of the hole when coring is not desired. With present practice, when cores are to be recovered, the stems are removed and a lightweight core barrel, of a relatively short length, is lowered into the auger sleeve to the bottom of the hole and then driven into the earth ahead of the drill, by a weight raised and released to produce a drop hammer effect. When the core barrel is driven as far as possible, usually from 12 to 18 inches, the hollow auger is rotated to move downwardly to the base of the core barrel. The loaded core barrel is then pulled out of the stem to recover the core within it.

A common problem in such a coring operation resides in the fact that soft and unconsolidated materials will usually jam within the core barrel when the core barrel is driven into the earth ahead of the drill. Core samples having a length of one foot, two feet or three feet at the most, are all that can be expected in such an operation. Moreover, when the core barrel is driven into the earth, the material within the core barrel, i.e., the core specimen, may be compacted or otherwise distorted to such an extent that the core can give erroneous indications when tested for properties, such as compressibility, permeability and the like. Finally, the core is often jammed into the barrel so tightly that the barrel has to be split or cut longitudinally to remove the core. This requires thin wall, single use core barrels. Therefore, in the present state of the art, the criticism that compacted core samples are not much better than drill cuttings appears to have some justification.

SUMMARY OF THE INVENTION

The invention comprises, in essence, a drilling system for obtaining cores of unconsolidated material by using an apparatus interconnecting the core barrel and the auger drill in such a manner as to permit the core barrel to remain stationary while the auger rotates. At the same time, the core barrel is moved downwardly with the auger to lead the auger bit a selected small distance to produce a continuous formation of a core and movement of the core into the barrel as the bit drills into the earth. The lead distance can be varied to accommodate different formations in such a manner as to keep a minimum cutting pressure at the leading edge of the core barrel. This permits the use of a sharp leading edge on a cutting ring at the base of the core barrel and the cutting of a core with a minimum pressure to minimize the tendency for the core within the barrel to be distorted or compacted.

Particularly for those formations where the core is apt to jam in the core barrel, the invention further comprises a simplified and reliable mode of fitting a friction reducing, elastic sleeve about the core as it is formed within the barrel and thus permit the core to freely slide upwardly into the barrel. This may be accomplished by use of a tubular holder on which the sleeve is installed, in bunched condition, for feeding into the core barrel and around the core as it moves from the holder. It is also desirable to proportion the size of the passages through which the core passes, such as a slightly less inner diameter of the cutting ring than the sleeve holder, whose inner diameter, in turn, is slightly less than that of the core barrel above the holder. With the improved apparatus, it is possible to obtain continuous cores having a length of five feet or more, even when the cores are of very soft and even of loose material. The cores are essentially completely undisturbed, and it has been found that, by suitably controlling the lead distance of the sharp core barrel edge, the effects of vibration of the cutting bit about the core barrel could be minimized. The improved sleeve is formed of nylon or other strong, low friction fiber woven in such a manner as to permit stretching of the woven sleeve from a compact, bunched condition on a holder near the base of the core barrel, which sleeve may form a tube 20 to 30 times its original, bunched length, to accommodate the entire core as it moves upwardly and into the barrel.

The use of the sleeve is especially desirable for coring unconsolidated material, although it was found that the sleeve would be useful in obtaining cores in harder formations or with other types of coring apparatus. Sometimes, in coring a hard formation, as with a diamond drill bit, alternating layers of hard and soft rock are encountered and the use of a bunched sleeve, as described above, will permit a suitable core of the soft formation to be recovered when, otherwise, it would be washed away or otherwise destroyed.

It follows that an object of the invention is to provide a novel and improved arrangement for installing and interconnecting a core barrel within a hollow auger to obtain cores of unconsolidated material, wherein the core barrel does not rotate with the bit and wherein the leading edge of the core barrel may be adjustably positioned a small distance above, or preferably below the bit of a hollow auger, to move downwardly with the bit to closely follow, or preferably lead the bit and most effectively penetrate the formation with minimum pressure against the leading edge of the core barrel. Another object is to provide a method and apparatus for guiding an elastic sleeve around the core and to eventually totally enclose the core and thereby preserve the structure of the core for examination. A further object is to provide such a method and apparatus which may be used dry, so as to preserve moisture or other liquid content of the core, for examination purposes.

THE DRAWINGS

The manner in which the foregoing and additional objects are accomplished, as well as additional features of this invention, will become apparent from the description which follows, taken in conjunction with the accompanying drawings, in which.

DETAILED DESCRIPTION OF PREFERRED EMBODIMENT

Figure 1:
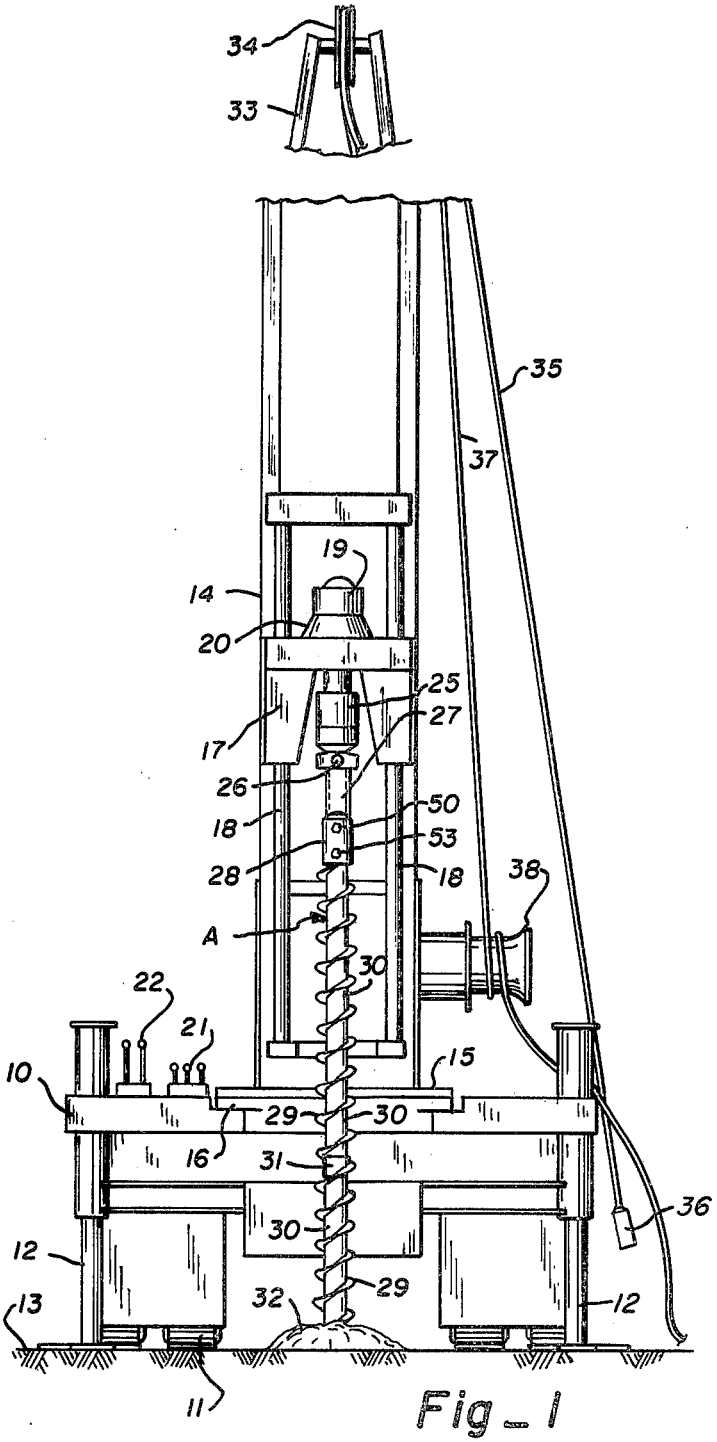
FIG. 1 is a rear elevation of vehicle mounted drilling equipment boring a hole in loose or unconsolidated material in which a core is to be taken.

Equipment used for drilling operations and in connection with which the core sampling apparatus of this invention is used may be mounted on a bed 10 of a truck or the like having rear wheels 11 and outriggers 12 alongside the rear wheels which extend into engagement with the earth 13. A derrick 14 is mounted on a horizontal slide 15 mounted on a guide 16, in turn mounted on the truck bed. A vertical slide 17 is mounted on guide rods 18 attached to the derrick, with the slide 17 being moved upwardly and downwardly by conventional hydraulic cylinders or drive chains (not shown). A hydraulic drive motor 19 is mounted on the slide 12 and is supplied with hydraulic fluid through hoses 20 which lead from one of a set of appropriately positioned control handles 21 mounted in an accessible offset position at the rear edge of the truck bed. Other control levers 22 control the hydraulic fluid supplied by an engine and pump which are conventional, and which, along with the reservoir, are mounted upon the truck bed in any suitable manner, not shown. While the drives are described as being hydraulically operated, it is understood that they may be mechanical, both types being used in the field. The hydraulic motor 19 rotates a connector 25, with a universal joint coupling 26 attached to a stem 27 at the top of a tubular coupling 28 which, in turn, is connected to the top of an auger A and is thereby adapted to rotate the auger A. The auger A has flights 29 about an auger tube 30 to lift earth upwardly from the bottom of the hole as cutting teeth on a bit D at the lower end of the auger move into earth formations. Several sections of the auger are interconnected, as by a bell 31 at the lower end of each auger section which fit over the next lower auger section.

During normal drilling operations, as the auger drills deeper into the earth, pushed downwardly by pressure exerted against slide 17, the slide moves downwardly along the rods 18 until the lower end of the rods is approached. At this time, the auger is disconnected from the link coupling 28 and an additional auger section is attached to the string of auger sections. In this way, additional sections, such as 5 or 10 foot lengths, may be added until the desired depth of the bore is obtained. The earth removed from the hole by the auger flights 29 forms a pile of debris 32 at the mouth of the hole.

For adding additional auger sections, and also for pulling the auger out of the hole when drilling is complete, a tower 33 extends upwardly from the top of the derrick and is provided with a rotatable sheave 34 over which a rope extends. A portion 35 of the rope, extending downwardly from the front of the sheave 34, is provided with a connector 36 for easy connection and disconnection with the top of each section of auger A, as after the link coupling 28 is disconnected. First, however, rearward movement of the derrick 14 to clear the upper end of the auger A permits easy attachment of the next auger section to the top of the prior auger section. For holding and maneuvering these sections and for hoisting the auger A, or an auger section for attachment or removal, the opposite section 37 of the rope extends downwardly from the sheave to a capstan 38, about which the rope is tightened for pulling upwardly, with pressure being released for lowering. After a sequentially next auger section has been placed in position and attached to the one below, as with cap screws, the connector 36 is released and the rope shifted to storage position, after which the derrick may be moved forwardly and the link coupling 28 reconnected, this time to the top of the newly installed auger section.

Within the lowermost section of the auger is a core barrel B, connected by one or more connected spacing tubes 40 through a thrust joint J, with a pressure block 41 in turn connected to stem 27 and the link coupling 28. The thrust joint J permits the core barrel B to remain stationary while the auger A rotates and at the same time permits a downward force to be exerted on the core barrel to thrust into the earth a cutting or incision ring R, at the lower end of the core barrel. Cutting ring R has, on the outside, a bevel 42 which provides a relatively sharp bottom cutting edge 43 adapted to be pushed into the earth as the auger digs its way into the ground, responsive to the pressure exerted from slide 17.

Figure 2:
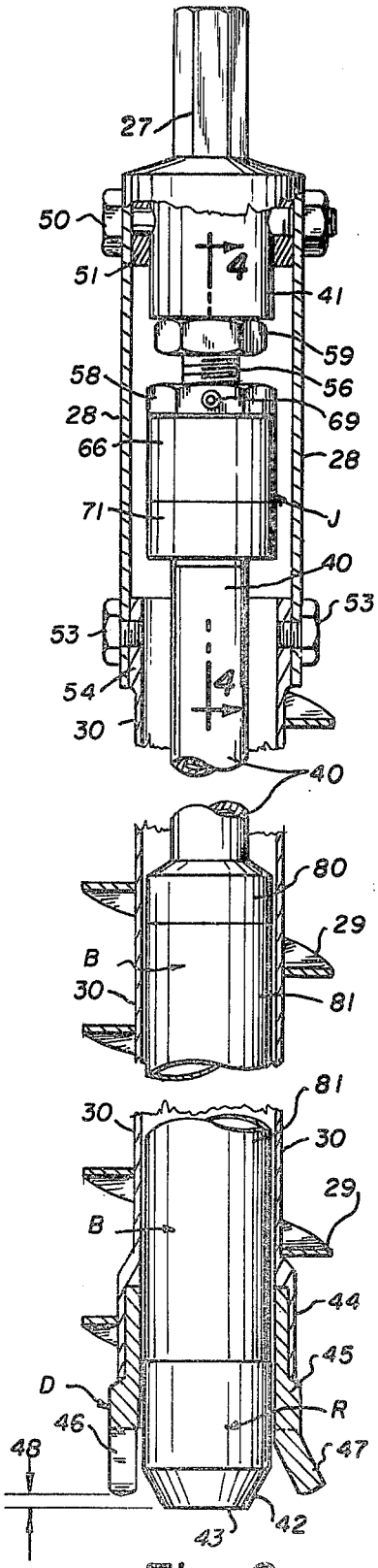
FIG. 2 is a condensed side elevation, on an enlarged scale, showing a core barrel of this invention within an auger of FIG. 1, with the auger in longitudinal section.
Figure 3:
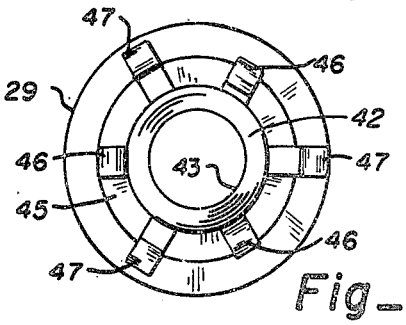
FIG. 3 is a bottom plan view of the auger and core barrel of FIG. 2.

At its lower end, the lowermost auger tube 30 may be provided with a bell 44 adapted to receive a relatively heavy ring 45 for forming the drill bit B to which teeth 46 and 47 are attached. The teeth 46 extend straight downwardly to cut closely to the core barrel and the alternating teeth 47 angle outwardly, as in FIGS. 2 and 3. As will be evident, the teeth 47 extend outwardly to a circle corresponding to the diameter of the auger flight 29. The positioning of the cutting edge 43 of ring R relative to the lower edges of the teeth 46 and 47 to a preferred distance above or below the lower edges of the teeth is indicated by the gap 48 of FIG. 2, the gap illustrating the cutting edge 43 as being below the teeth, although it may be sometimes a short distance above the teeth. This is an important adjustment for the most successful operation of the core barrel in the coring operation. This distance is adjusted by a suitable adjustment device described below which may be conveniently placed between pressure block 41 and thrust joint J. For core barrels having an inside diameter of about 3 or 3.5 inches, respectively, the distance of gap 48 may be varied on the order of one inch above the teeth to as much as 5 inches below the teeth, depending upon the earth characteristics. For hard earth formations, the cutting edge 43 may be above the teeth, and for soft formations, the cutting edge will be below the teeth, and for very soft material, the cutting edge will be further below the teeth. An operator can usually make a proper adjustment by observing the operation of the drilling apparatus.

During drilling, when coring is not desired, a cutter, not shown, having teeth corresponding to teeth 46 and depending from spacing tubes 40 but connected to the link coupling 28, is received within the ring 45 of the bit D. For coring, the pressure block 41 is attached by a bolt 50 and installed within a bell 51 within the link coupling 28, as in FIG. 2, block 41 being provided with a hole 52, as in FIG. 4, for receiving bolt 50. Cap screws 53 attach links 28 to a thickened ring 54 at the upper end of tube 30 of the uppermost auger section, the cap screws engaging threaded holes in the thickened ring 54. Corresponding upper ends of lower auger sections are received within bells 31 at the lower ends of the adjacent auger sections, as in FIG. 1, while cap screws, not shown, corresponding to cap screws 53 attach the auger sections together.

Figure 4:
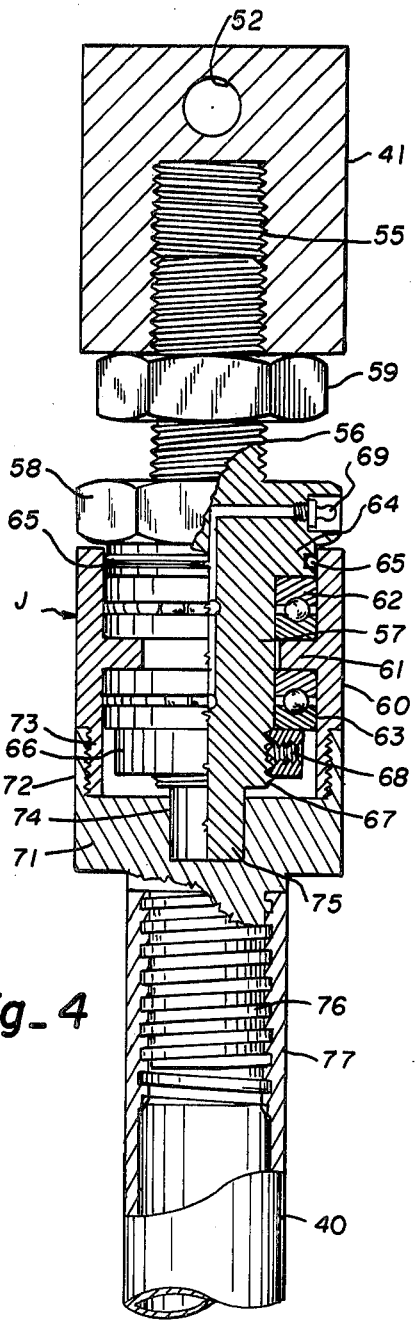
FIG. 4 is a fragmentary longitudinal section, on an enlarged scale and taken along line 4—4 of FIG. 2, showing the construction of a pivot thrust joint for the core barrel which permits the core barrel to remain stationary while the auger rotates.

Pressure block 41, as in FIG. 4, is provided with an internally threaded socket 55 adapted to receive a threaded stem 56 extending upwardly from a shaft 57 having a hexagonal head 58 at the base of the stem 56. The hexagonal head 58 is utilized to turn stem 56 into the socket 55 to adjust the vertical position of the core barrel B within the auger, which is fixed in the adjusted position by a lock nut 59 on stem 56 and bearing against the underside of block 41. A sleeve 60 surrounds shaft 57 and is rotatable with respect thereto, sleeve 60 having a center rib 61 against which thrust type ball bearing assemblies 62 and 63 bear from above and below, being mounted on shaft 57. The upper ball bearing assembly 62 bears upwardly against a top flange 64 of shaft 57, with flange 64 being provided with a slot for a seal ring 65 within sleeve 60, while lower ball bearing assembly 63 bears downwardly against a collar 66. The tightness of the ball bearing assemblies is determined by the collar 66, which is threaded onto threads 67 on shaft 57 and locked in position by a set screw 68. It will be noted that the ball bearing assemblies 62 and 63 not only are required to permit the core barrel B to remain stationary while the auger rotates, but also to resist the force required to push the core barrel into the earth. The upper end of shaft 57 is provided with a grease fitting 69 for supplying a lubricant, through suitable holes within the shaft, to the ball bearing assemblies. To complete the thrust joint J, the lower end of sleeve 60 is closed by a cylindrical, lower cap 71 having an internally threaded, upstanding flange 72 connected to a correspondingly externally threaded, depending flange 73 of sleeve 60. Cap 71 is also provided with a central socket 74 for receiving depending, centering pin 75 of shaft 57. For connection to tube 41, the lower cap 71 is provided with a depending stem 76 having threads, such as shown, which are especially adapted to transmit the force necessary to thrust the core barrel into the earth but to deter any loosening, such as Acme type threads. These threads engage corresponding threads on the inside of an upper portion 77 of tube 41, portion 77 being thickened by swaging or the like.

Several tubes 41 are connected together to extend a distance corresponding to the length of auger A and to connect with the top of the core barrel B. A portion 78 at the lower end of each tube 41, as in FIG. 5, may be reduced in diameter and thickened, in order to cut similar square threads to engage an upper portion of another tube, not shown, and also to engage corresponding threads of a bore 79 in a cap 80 at the top of the core barrel B. Cap 80 is thread connected to the tube 81 which forms the core receiving portion of the core barrel B. The tube 81 is provided at its upper end with interior threads 82, as of the Acme type, to engage corresponding threads on the outside of the lower portion of cap 80, which includes a depending flange 83 below the lower end of bore 79. Cap 80 is removed in the event it is necessary to push the core out of the core barrel, although this has been found to be relatively infrequent, or to replace tube 81 in the event of damage.

Figure 5:
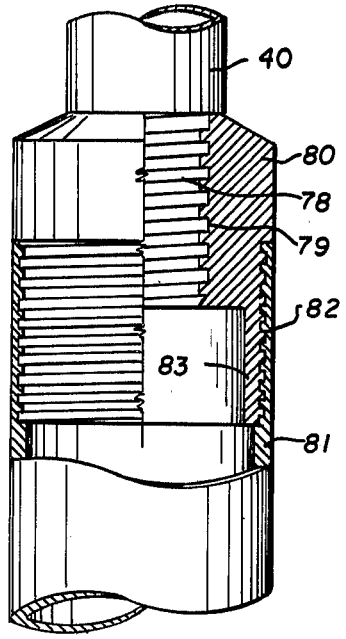
FIG. 5 is a condensed side elevation, on an enlarged scale, of the core barrel with certain parts broken away and portions of others in longitudinal section to show the construction more clearly.
Figure 5:
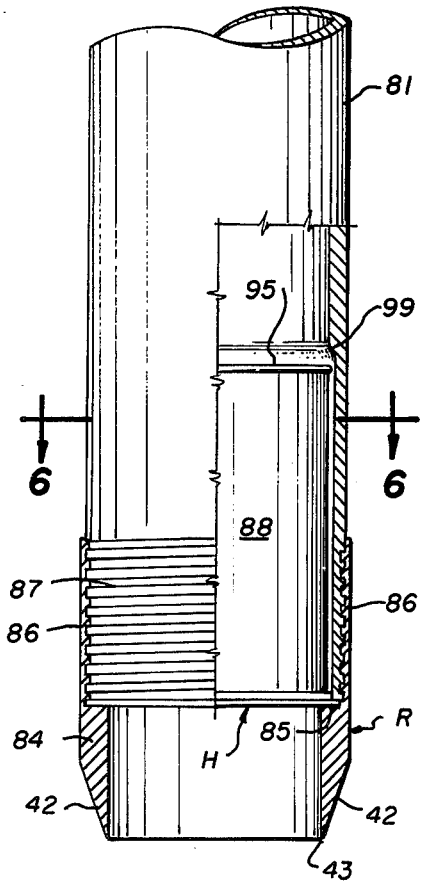
Figure 6:
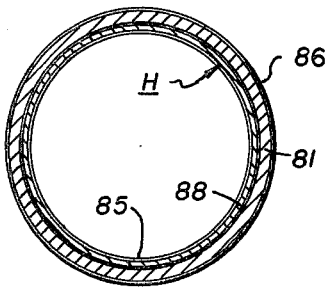
FIG. 6 is a transverse section taken along line 6—6 of FIG. 5.

Cutting ring R, as indicated previously, is mounted at the lower end of the core barrel, as in FIGS. 5 and 6, and has a relatively thick body 84 on which the outside bevel 42 is formed and which extends up to an interior shoulder 85. Above shoulder 85, an upstanding flange 86 is threaded on the inside to engage threads 87 on the outside of the lower end of tube 81, again preferably of a type resistant to loosening, such as Acme threads.

Figure 7:
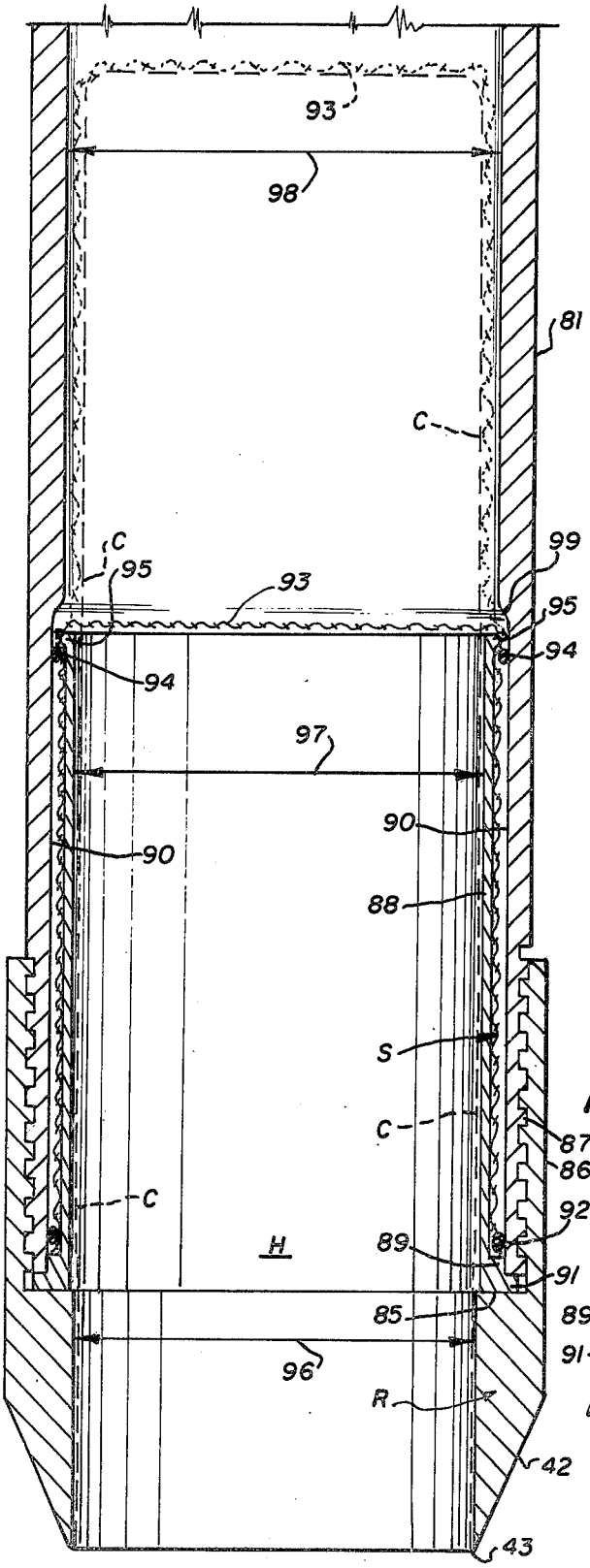
FIG. 7 is a further enlarged longitudinal section of the lower portion of the core barrel, showing particularly a holder within the core barrel which carries an expansible, resilient sleeve for encompassing the core as the core moves into the barrel.
Figure 10:
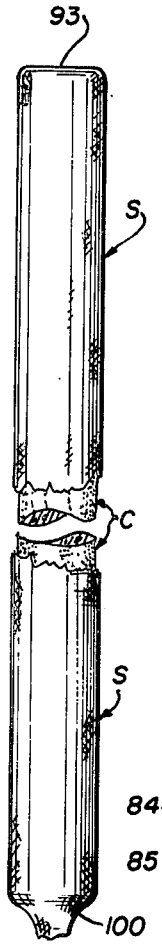
FIG. 10 is a condensed side elevation, on a reduced scale, of a core encompassed by the sleeve after removal from the core barrel.
Figure 8:
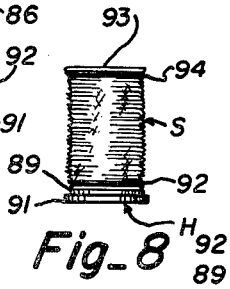
FIG. 8 is a side elevation, on a reduced scale, of the holder with the resilient sleeve installed on it, prior to assembly with the core barrel.
Figure 9:
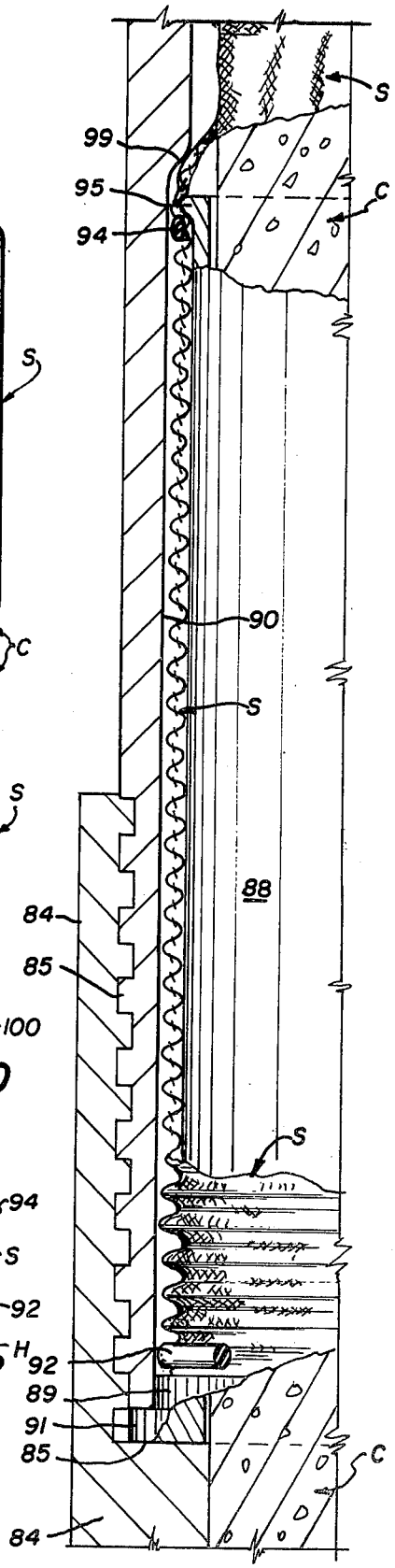
FIG. 9 is a fragmentary longitudinal section, on a further enlarged scale, of a portion at the left side of FIG. 7, showing particularly the position of the resilient sleeve and core within the core barrel, as the barrel moves over the core and the core moves into the barrel.

In accordance with this invention, the inside shoulder 85 at the base of flange 86 of ring R, as in FIG. 7, forms an abutment for a holder H adapted to carry a resilient sleeve S which encloses a core as the core is cut and moves up inside the core barrel, as indicated by dash lines C. Sleeve S is preferably woven of a low friction fiber, such as nylon, in a manner to permit stretching of the sleeve from the compacted position of FIG. 8 to the elongated position of FIGS. 9 and 10, in which it surrounds a core C. Initially, the open end of sleeve S, which may be a nylon stocking or one leg of a nylon pantyhose, is slipped onto the holder H and moved downwardly along the side wall 88 of the holder until a smaller diameter circular flange 89 is reached, as in FIG. 8. As in FIG. 7, flange 89 fits within a slightly enlarged inner wall portion 90 of tube 81, extending upwardly from the lower end of the tube for a distance slightly greater than the height of the holder H. A lower flange 91 of the holder fits beneath the lower end of tube 81 and is clamped thereagainst by shoulder 85. A resilient holding band 92, as of rubber, is placed around the lower end of the sleeve S when it reaches flange 89, then movement of the sleeve onto the holder H is continued until substantially the entire length of the sleeve is pushed onto the holder, with the sleeve in the bunched condition of FIG. 8. In this condition, the closed end 93 of the sleeve, which then becomes the top, extends loosely across the top of the holder H, at which time another flexible friction band 94, again as of rubber, is placed around the sleeve just below an outward bulge or lip 95. To maintain the bunched condition of the sleeve, the friction band 94, whereunder the sleeve S will slip, and the lip 95 provide some resistance to movement of the sleeve off the holder as the core pulls additional sequential increments of the sleeve off the holder as the core moves upwardly and into the core barrel.

In further accordance with this invention, it is necessary that a certain relationship be provided between the inside diameter of the ring R, the holder H and the tube 81. Thus, the inside diameter of the ring R, as indicated by the dimension 96, should be slightly less than the inside diameter of the holder H, as represented by the dimension 97. This permits the core, as indicated by the dash line C of FIG. 7, to enter the ring R and then the holder H, as the core barrel moves downwardly into the earth to form the core, without being unduly impeded by frictional resistance of the holder H, even though there may be a slight expansion of the core as it moves through the holder. Similarly, the inside diameter of the tube 81 represented by the dimension 98, should be greater than the inside of the holder H, or dimension 97, so that the sleeve will have little difficulty moving along with the core and within the tube, but stretching as it does so, in order that a resiliently knitted sleeve having a normal length of less than 3 feet may cover a 6 foot core.

As the upper end of the holder H moves past the upper end of the core, the upper end of the core will engage the closed end 93 of sleeve S and stretch the closed end upwardly until the sleeve begins to be pulled off the holder. The purpose of the flexible band 94 is to maintain the sleeve on the holder until actually pulled off the upper end of the holder by the core moving relative to the core barrel and also, in cooperation with the lip 95, to provide a light frictional drag to stretch the sleeve S about the core. Actually, of course, the core barrel is moving downwardly while the core is stationary, but the top 93 of the sleeve and the core C are moving upwardly relative to the holder H. The corner at the upper end of the lower portion 90 of the tube 81 should be a rounded fillet 99, to assist the sleeve S to smoothly move off the holder and about the core and also provide some resistance to this movement and assist in maintaining the remainder of the sleeve in its bunched state on the holder until it is pulled off as consecutive stretched portions. As in FIG. 7, the dotted position of the core C indicates that the core barrel has moved down over the core until the closed end 93 of the sleeve has been pulled off the holder H and moved upwardly to the dotted position thereof shown within the tube 81. As in FIG. 9, the core and sleeve have moved substantially to the full position of the core, with the remainder of the sleeve stretched over the holder H between the flexible bands 92 and 94.

When the core is to be removed from the core barrel, after the core barrel has been pulled up out of the hole from within the auger section, the core barrel may be guided onto an inclined U-shaped wooden trough, not shown, and the cutting ring R then removed through the use of wrenches. This will expose the holder H and the lower end of the core. The flange 91 of the holder H is then loosened from the lower end of tube 81, so that the holder and the core retain generally their position within the core barrel. However, with the lower end of the loosened holder resting against an abutment at the lower end of the inclined trough, the barrel may be pulled upwardly along the trough and the core and holder enveloped within the sleeve will move out of the barrel and remain in the trough. After the core barrel has been removed, the trough may be laid in a horizontal position and the holder H removed carefully from between the core and the sleeve. Then, until the core is ready to be checked and/or tested, the open end of the sleeve may be pulled over the lower end of the core, closed and fastened, such as at the lower end 100 of the sleeve S in FIG. 10.

After the core has been thus removed, a new sleeve may be mounted upon the holder, the holder H reinstalled, the ring R fastened in place and the core barrel reinserted within the auger. Then an additional flight may be added to the auger, the thrust joint J reattached and the two assemblies again attached to the drive mechanism, whereupon the auger may be drilled downwardly for the next flight and a corresponding core taken. Similar core recovery operations may then be repeated. When the depth at which cores are to be taken is reached and after the final core has been recovered, the drive may be reconnected to the auger and the auger pulled out of the hole in a conventional manner.

Although a preferred embodiment of this invention has been illustrated and described and additional areas of use indicated, it will be understood that other embodiments may exist and various changes may be made, all without departing from the spirit and scope of this invention.

What is claimed is:

1. In coring apparatus for obtaining cores of earth materials or formations of the type wherein a core barrel is disposed within hollow earth, dry drilling means having a hollow bit at its bottom and a coupling means at its top for connection with a rotary drive means for rotating said drilling means and moving said drilling means downwardly as it rotates, the improvement comprising:

(a) a short, core cutting ring at the base of the core barrel having a sharp cutting edge at the bottom thereof and a passageway extending upwardly from the cutting edge to the interior of the core barrel, with the diameter of the cutting edge and passageway being slightly less than the internal diameter of the core barrel;

(b) a swivel adapted to be placed within said drilling means adjacent the top thereof, for connection with said coupling means to permit the core barrel to remain stationary as said drilling means rotates and to cause the core barrel to move downwardly with downward movement of said drilling means;

(c) a hollow sleeve holder above said cutting ring and within said core barrel, said holder having an inside diameter intermediate the inside diameters of said cutting ring and core barrel and providing an annular space between said holder and the inside of said core barrel;

(d) a bunched, stretchable sleeve means within said annular space and having its lower end restrained against upward movement, with its closed upper end extending across the upper end of said holder and adapted to be engaged by a core moving into the core barrel, whereby said sleeve will embrace said core, hold portions of said core in position and reduce frictional drag of said core upon the inner wall of said core barrel; and (e) resilient means engaging said sleeve adjacent the upper end of said holder for feeding said sleeve from said annular space and stretching consecutive portions of said sleeve as said sleeve moves from said holder and about the core moving into said core barrel.

2. The apparatus defined in claim 1, including:

adjustable extension means, to extend the cutting edge of the core barrel cutting ring a short selected distance above or below said bit, whereby the cutting edge will remain at such selected distance relative to said bit as said bit moves downwardly.

3. The apparatus defined in claim 1, wherein:

said drilling means includes a tube surrounding said core barrel for connection between said coupling means and said drilling bit, with an auger flight surrounding said tube in spiral relation thereto.

4. The apparatus defined in claim 1, wherein:

said sleeve is a knitted, stretchable fabric formed of a material having an exterior coefficient of friction on the order of that of nylon.

5. The apparatus defined in claim 1, wherein:

said sleeve is a knitted, stretchable fabric; and said resilient means engaging said sleeve is a resilient band surrounding said sleeve.

6. In combination with a core barrel having a leading end adapted to move into earth material or formations:

a bunched, stretchable sleeve means within said core barrel adjacent to the leading end of said core barrel, with the leading end of said sleeve fixed within said core barrel and with the trailing end of said sleeve being closed and adapted to be engaged by a core moving into said core barrel, whereby said sleeve will embrace said core and hold portions of said core in position;

a hollow sleeve holder within said core barrel having its leading end adjacent to the leading end of said core barrel and having an inside diameter less than the inside diameter of said core barrel;

an annular space between said holder and the inside of said core barrel with said sleeve being bunched in said annular space with its closed trailing end extending across the trailing end of said holder;

a smooth, outwardly extending lip at the trailing end of said holder; and a resilient band about said sleeve adjacent said lip, whereby the sleeve will slip underneath said band and around said lip as it is pulled from said holder by a core moving into said core barrel, said lip and band providing drag means adjacent the trailing end of said holder to resist movement of the sleeve, whereby consecutive portions of the sleeve are stretched as said sleeve moves off said holder and about a core moving into the barrel.

7. The combination defined in claim 6, including:

a short, core cutting ring at the leading end of said core barrel having a sharp, leading edge and a passageway extending therefrom and to the interior of the core barrel, with the diameter of the cutting edge and passageway being slightly less than the internal diameter of said holder.

8. The combination defined in claim 7, wherein:

said cutting ring has an internal shoulder; and said sleeve holder has an outer flange at its leading edge proportioned to abut against said shoulder.

9. The combination defined in claim 8, wherein:

said core barrel includes a tube having a leading end adapted to abut said flange of said sleeve holder; and means attaching said cutting ring to said tube to clamp said flange of said sleeve holder between the leading end of said tube and said ring abutment.

10. In a method of collecting a core of earth material permeable by a non-rotating core cutting ring pushed into said material and without the introduction of liquid to a drilling bit surrounding said cutting ring, the steps comprising:

connecting a core barrel to a thrust joint depending from drive means for rotating a tube adapted to surround said core barrel and carrying an annular drilling bit, said drive means producing a thrust on both said core barrel and drill tube and said thrust joint permitting said core barrel to remain stationary as said drill tube and drill bit are rotated by said drive means;

assembling an open bottom sleeve in bunched condition on the outside of a sleeve holder having an inner diameter less than the inner diameter of said core barrel and removably attaching the lower end of said bunched sleeve to the outside of said holder, with the upper end of said sleeve extending across the open top of said holder;

placing said sleeve holder, with said bunched sleeve thereon, inside the lower end of said core barrel and within an interior enlargement of said core barrel, whereby the end of said sleeve extends across the upper end of said holder and will be engaged by said core as said core barrel is pushed downwardly into said earth material, whereby said core will move said end of said sleeve in a relative upward direction with respect to said holder and said sleeve will encompass and enclose successive portions of said core;

attaching said annular cutting ring to the bottom of said core barrel, said cutting ring having a sharp lower edge to penetrate said earth material as pressure against said thrust joint produces downward pressure on said core barrel;

connecting to said drive means a tube carrying at its lower end said annular drill bit and in a position surrounding said core barrel, with said drill bit in a preselected position relative to said cutting ring;

lowering said tube with said drill bit and said core barrel with said core cutting ring into engagement with the earth material from which the core is to be taken; and rotating said tube and drill bit through said drive means and permitting said core barrel to remain stationary while exerting pressure against both said drill tube and said core barrel until said core cutting ring has been moved into said earth material a distance corresponding to the length of the core to be taken and said sleeve has encompassed that portion of said core projecting upwardly beyond said sleeve holder.

11. In the method defined in claim 10, including:

removing earth material dislodged by said drill bit during drilling by moving the same upwardly in the hole produced by said drill bit through an auger flight extending spirally around and attached to the outside of said tube.

12. The method defined in claim 10, including:

after termination of said rotation of said drill bit, removing said drill tube and core barrel from the hole produced by such drilling;

removing said drill bit and tube to which said drill bit is attached;

removing said cutting ring from the lower portion of said core barrel;

disengaging said sleeve holder from said core barrel; and pulling said holder and the core enclosed by the expanded sleeve from said core barrel.

13. The method defined in claim 12, including:

attaching said sleeve holder within said core barrel by clamping a lateral flange on said sleeve holder between an inner abutment on said core cutting ring and the lower end of said core barrel, while threadedly attaching said core cutting ring to the lower end of said core barrel.

14. The method as defined in claim 12, wherein:

the inner diameter of said core cutting ring is less than the inner diameter of said sleeve holder.

15. The method as defined in claim 12, wherein:

said sleeve is a knitted, stretchable fabric formed of a fiber having an exterior coefficient of friction on the order of that of nylon, whereby said sleeve will reduce the frictional drag of the core against the inner walls of the core barrel.

16. The method as defined in claim 12, which includes:

connecting one or more additional tubes between said drive means and the tube carrying said cutting bit; and connecting extension means between said core barrel and said thrust joint, when the depth of the hole at which the taking of a core is to be started exceeds the length of said core barrel or said tube carrying said drilling bit.

17. In the method as defined in claim 16, including:

securing successive cores at successive depths through the addition of tube extensions and core barrel extension means of corresponding lengths for each additional core.

18. In the method as defined in claim 16, wherein:

said additional tubes have spiral auger flights on the outside thereof.

* * * * *

UNITED STATES PATENT AND TRADEMARK OFFICE

CERTIFICATE OF CORRECTION

PATENT NO. : 4,156,469

DATED : May 29, 1979

INVENTOR(S) : John G. Laskey

It is certified that error appears in the above-identified patent and that said Letters Patent are hereby corrected as shown below:

Column 12, line 6 (Claim 15), "12" should read --10--;
line 12 (Claim 16), "12" should read --10--.

Signed and Sealed this

*Fourteenth* Day of *August 1979*

[SEAL]

*Attest:*

*Attesting Officer*

LUTRELLE F. PARKER

*Acting Commissioner of Patents and Trademarks*